United States Patent [19]

Williams

[11] Patent Number: 4,989,693

[45] Date of Patent: Feb. 5, 1991

[54] GAFF PROTECTIVE COVER

[75] Inventor: Danny R. Williams, Houston, Tex.

[73] Assignee: Houston Industries Incorporated, Tex.

[21] Appl. No.: 514,530

[22] Filed: Apr. 26, 1990

[51] Int. Cl.[5] ..... A63B 27/02

[52] U.S. Cl. ..... 182/221; 182/134

[58] Field of Search ..... 182/221, 133, 136

[56] References Cited

U.S. PATENT DOCUMENTS

| | | | |
|---|---|---|---|
| 1,931,823 | 10/1933 | Hushour | 182/221 |
| 1,981,755 | 11/1934 | Serene | 182/221 |
| 2,296,074 | 9/1942 | Weed | 182/221 |
| 2,419,363 | 4/1947 | Minney | 182/221 |
| 2,497,710 | 2/1950 | Wollensack | 182/221 |
| 2,870,947 | 1/1959 | Hendry | 182/221 |
| 3,135,352 | 6/1964 | Hutchings | 182/221 |
| 3,640,358 | 2/1972 | Smith | 182/221 |
| 4,282,951 | 8/1981 | Zelins | 182/221 |

*Primary Examiner*—Reinaldo P. Machado

*Attorney, Agent, or Firm*—Pravel, Gambrell, Hewitt, Kimball & Krieger

[57] ABSTRACT

A gaff guard for a gaff on a line crew member's climbing iron that may be permanently attached to the shank of the climbing iron. When the gaff is in use, the guard is conveniently and safely stowed in a rest position in a cavity in the means attaching the gaff guard to the shank. Thus, the guard is not subject to being misplaced. When the gaff is not in use, the guard is pivoted downward and a socket covers the gaff, protecting the gaff point and the surroundings.

15 Claims, 2 Drawing Sheets

GAFF PROTECTIVE COVER

FIELD OF INVENTION

The invention relates to a gaff guard for covering and protecting the point of a gaff on a line crew member's climbing iron. The gaff guard is particularly useful in protecting the line crew member and other persons from the gaff and in protecting the point of the gaff where the climbing iron is being worn but the line crew member is not ascending or descending from a pole.

BACKGROUND OF THE INVENTION

Line crew members wear climbing irons to facilitate in ascending a pole and to assist in safely remaining in position on the pole. These climbing irons, which are usually strapped to the line crew member's boot, are equipped with sharp-pointed gaffs that penetrate the wooden poles. This penetration of the gaff into the wood provides support for the line crew member and facilitates both climbing of the pole and stability once in a work position.

When line crew members have descended from poles, they would generally prefer not to unstrap their climbing irons but to retain these in position. However, on the ground an exposed, sharp-pointed gaff presents a hazard to the line crew member and immediate surroundings. Line crew members have accidentally injured themselves and others with these exposed gaffs. Moreover, the gaffs themselves can become blunted by contact with hard surfaces in the normal course of a line crew member walking over pavement or hard ground surfaces. A blunted gaff, being less able to penetrate a wooden pole, in itself also presents an increased risk of injury. Thus, some employers have, as a matter of policy, required that their line crew members either remove the climbing irons when they are no longer needed or that the sharp gaffs be covered until they are once again needed.

Several gaff guards have been developed, for instance, U.S. Pat. No. 4,282,951 is directed to a gaff guard of resinous material that slips over the gaff and clips onto the back face of the leg iron. These clips have the advantage of being light-weight and easy to use but they suffer the significant disadvantage of being easily dislodged in use and are consequently easily lost.

U.S. Pat. No. 2,497,710 is directed to a metallic gaff guard that surrounds the gaff with a conical-shaped coiled spring with clips that clamp onto the leg iron. Again, like the gaff guard of U.S. Pat. No. 4,282,951, the guard of U.S. Pat. No. 2,497,710 is lightweight and easy to use but is also relatively easily dislodged and lost. In an alternative embodiment, this latter patent shows a gaff guard that can be clamped to the leg irons more securely than by clips. However, in order to remove this gaff guard from the gaff, the clamp must be loosened by unscrewing. Further, since the guard must be removed when not in use, it is also liable to be lost.

U.S. Pat. No. 2,296,074 shows a gaff guard that is attached to the leg iron and that is equipped with a spring. The guard assembly includes a means for attachment to the leg irons, which is in turn attached to one end of a spring. A metal plate extends from the other end of the spring and ends in a socket which covers the gaff. To remove the gaff guard, the socket is removed by elongating the spring vertically downward and pulling the socket from the guard. The socket, metal plate and spring assembly can rotate 180 degrees about the point of attachment to the leg iron so that the socket may be clipped onto a hook which is attached to the leg iron. While this device provides a useful alternative to those gaff covers that must be completely attached or completely removed, it still has the disadvantage of having an exposed spring which is susceptible to being snagged onto equipment, underbrush, etc. in normal use and thereby being damaged.

A need exists for a gaff guard that will provide safety and convenience so that it would be effective in covering the gaff point while the gaff is not in use and could also be stowed securely and conveniently out of the way while the gaff is in use. Furthermore, the gaff guard should be rugged and capable of withstanding normal wear and tear.

SUMMARY OF THE INVENTION

The present invention provides a gaff guard that is easy to install on line climbing irons used by crew members. Further, when the gaff guard is not in use, i.e. when it is not used to cover the gaff, it can be conveniently and safely stowed without removing it from the climbing iron. Thus, the gaff guard is not readily misplaced or lost. Further, the construction of the gaff guard is rugged so that it can withstand the rigors of use under ordinary conditions.

The invention gaff guard provides a socket, including a metal component, covered with a polymeric composition. This provides strength to withstand impacts and normal wear and tear as well as a soft surface to avoid damage to the sharp point of the gaff or injury to personnel. The socket is attached to a gaff guard assembly which may be permanently clamped onto the climbing iron. When the gaff is in use, the gaff guard may be pivoted upward through about 180° for stowing in a rest position.

DESCRIPTION OF THE PREFERRED EMBODIMENT

Figure 1:
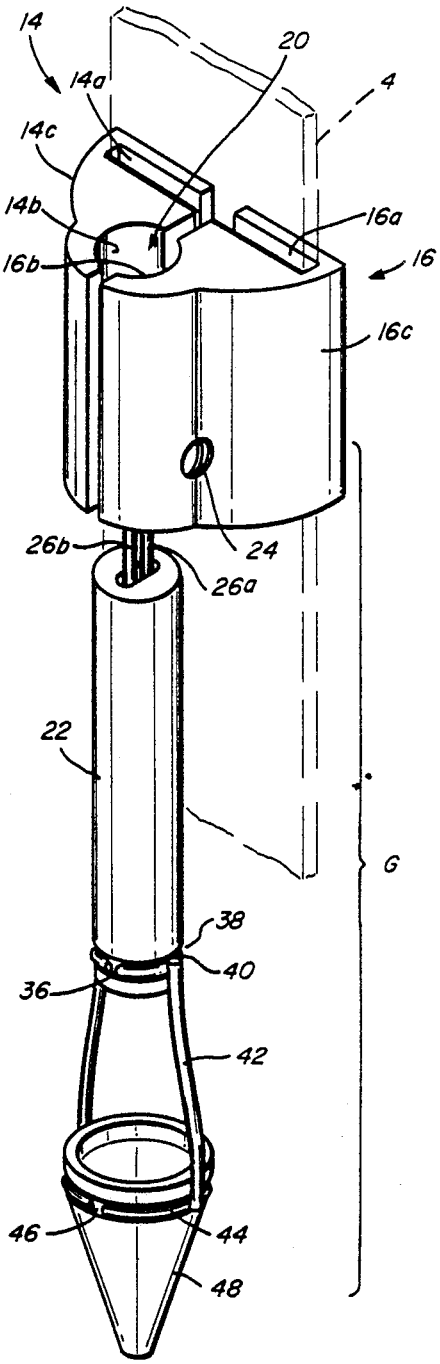
FIG. 1 is a perspective view of a gaff guard of the present invention.

In the drawings, the letter G (FIG. 1) indicates a gaff guard according to the present invention. Gaff guard G provides a convenient means for covering a gaff F (FIG. 4) on a line crew member's climbing iron I. Further, when the gaff guard G is not needed, it may be pivoted to a rest or stored position (FIGS. 3 and 5) while still affixed to the climbing iron I. In this rest position, the gaff guard G is safely out of the way and the line crew member can perform ordinary work without hindrance. Moreover, the gaff guard G is of rugged construction and able to withstand the normal wear and tear to which climbing equipment is subject.

A climbing iron I is, as is conventional, equipped with a sharp pointed or barbed gaff 2, a leg or shank portion 4 which is fitted along side the climber's leg below the knee, and a stirrup 6 which is fitted into the climber's boot instep beneath the leg portion 4. The climbing iron I also has an eyelet 8 at an upper position of shank 4 opposite stirrup 6 through which is passed a belt or strap to attach the climbing iron I to the line crew member's boot. A ring loop 10 is formed on stirrup 6 for connection of the climber's feet to a conventional lower climbing strap.

The gaff guard G is attached to the shank 4 of the climbing iron I by a coupling means 12. The coupling means 12 includes oppositely facing clamp segments 14 and 16, which have rectangular grooves **14*a* and 16*a* along their vertical extent to define a slot 18 sized to accept the shank 4. As will be set forth, clamp segments 14 and 16 can be moved toward and away from each other to vary the size of the slot 18**.

The segments 14 and 16 also have semi-circular vertically extending recesses **14*b* and 16*b* in outer body portions 14*c* and 16*c*, respectively. The recesses 14*b* and 16*b* define a longitudinal cylindrical cavity 20 sized to accommodate a cylindrical spring housing 22 (FIGS. 3 and 5**) when the gaff guard G is in the rest position.

The segments 14 and 16 are interconnected by a connector member 24 which takes the form of a screw or bolt which passes through a horizontal port **14*e* of clamp segment 14 and a similar port in clamp segment 16. Connector member 24 positions the segments 14 and 16 together so that they can be clamped fixedly onto shank 14. A nut or threaded sleeve is mounted in the port in clamp segment 16 so that screw or bolt 24 may be advanced or retracted, adjusting the width of slot 18 based on the width of the shank 4**.

Figure 2:
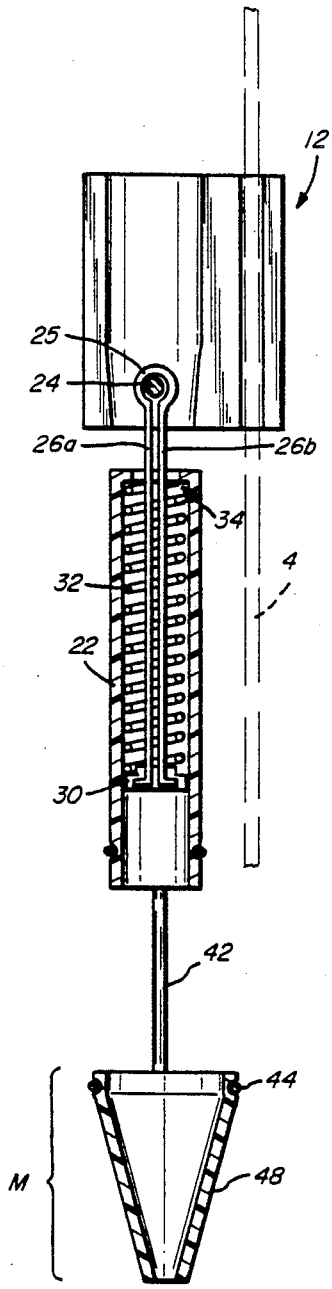
FIG. 2 is a cross-sectional view of the gaff guard of FIG. 1.
Figure 3:
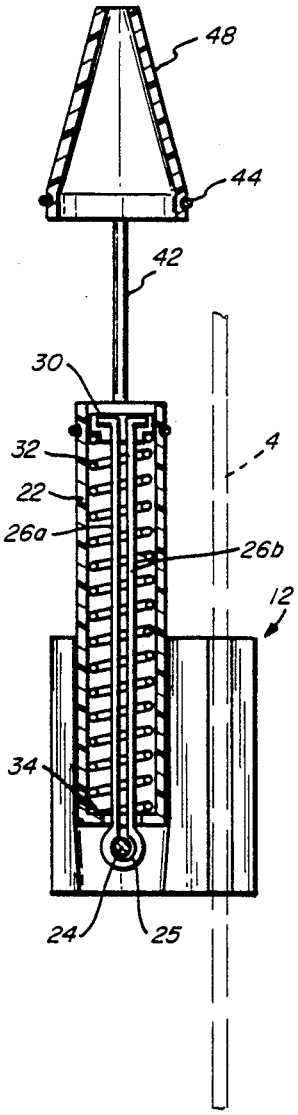
FIG. 3 is another cross-sectional view of the gaff guard of FIG. 1.
Figure 4:
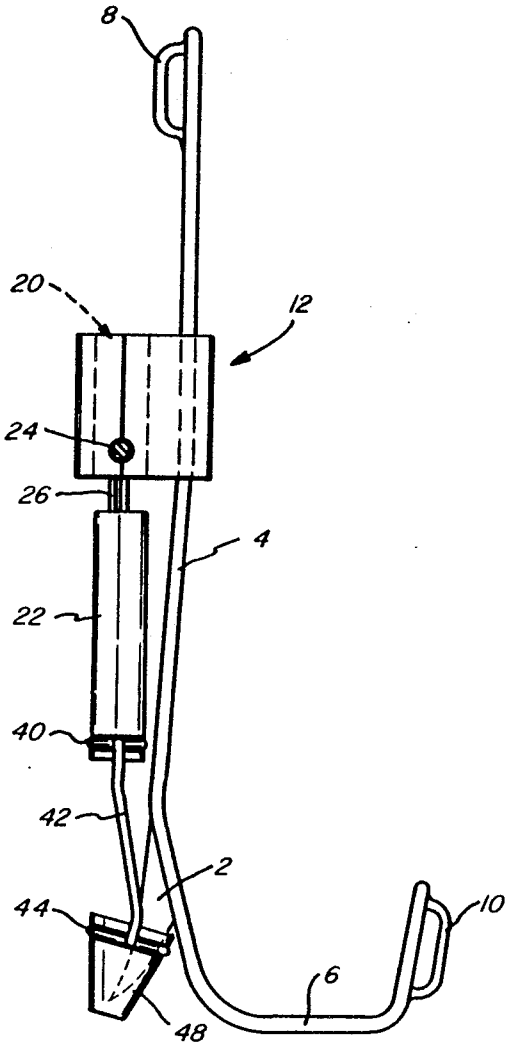
FIG. 4 is an elevation in partial cross-section showing the gaff guard socket in position over the gaff.

A pivoting means P fits over the connector member 22 of the coupling means 12 to allow a gaff cup member M of the gaff guard G to pivot the cup member M from a covering position (FIG. 4) to a rest or stored position (FIG. 3). The amount of such pivotal movement is through an arc of about 180° about the coupling means The pivoting means P can take the form of a pivot ring or eyelet 25 formed in an upper portion of a plunger rod 26, as for instance by bending the rod 26 around a circular piece. The pivot ring 25 encircles a shaft portion 28 of screw or bolt 24 of connector member 22 (FIGS. 2 and 3). Plunger rod 26 may be either a pair of rods (**26*a* and 26*b*) as shown, or may be a single such rod member, extending into cylindrical spring housing 22**.

Plunger rod 26 is attached at an end opposite pivot ring 24 to a stop means or plug 30 movably disposed within the spring housing. The spring housing 22 also contains a resilient spring means, preferably a simple coil spring 32 mounted in a position surrounding the rod 26. The spring means is mounted for compression and expansion between the movable stop means 30 and a fixed wall upper end 34 of spring housing 22.

An annular recess or slot 36 is formed at least partially encircling an outer lower end 38 of spring housing 22. One or more arcuate connector rings 40 are snap-fitted into slot 36. Extending away from each ring 40 and the housing 22 is a cup connector rod 42. An arcuate cup connector ring 44 is fitted within an annular recess or slot 46 formed at an upper end of a gaff cover cup 48.

The gaff cover cup 48 is a generally conically shaped member formed from an organic polymeric composition, which is preferably a thermoplastic composition. If desired, a metal stiffener core, either mesh or coiled, may be embedded in the organic polymer of gaff cover cup 48 for additional support and strength. The stiffener core provides the gaff cover cup 48 with strength and durability, while the organic polymer provides a soft, ductile surface which yieldingly fits over the sharp pointed gaff 2.

In this manner, the barbed gaff 2 is protected from dulling by contact with objects when not in use. Also, the risk of injury to the climber or other workers from the gaff 2 being uncovered is substantially reduced.

The gaff guard G of the present invention is easily installed onto the shank 4 of the climbing iron I, either when the iron I is being made or as a field retrofit. The clamp segments 14 and 16 are fastened onto the shank 4 so that shank 4 fits within slot 18. The connector member 24 is then tightened down until the gaff guard G is firmly mounted on the clamping iron I. The gaff cover cup 48 is then pulled downwardly toward the gaff 2, thereby compressing the spring 32 in housing 22, and fitted over the pointed end of gaff 2.

Once the gaff cover cup 48 is so fitted over the gaff 2, pulling force on the spring 32 is released. The force of spring 32 then holds the gaff cover cup 48 snugly in place. When it becomes necessary to use the climbing iron I, the gaff cover cup 48 is pulled downwardly, compressing spring 32. The gaff cover cup 48 may then be lifted upwardly about pivot ring 25 while retaining the spring 32 in compression.

Figure 5:
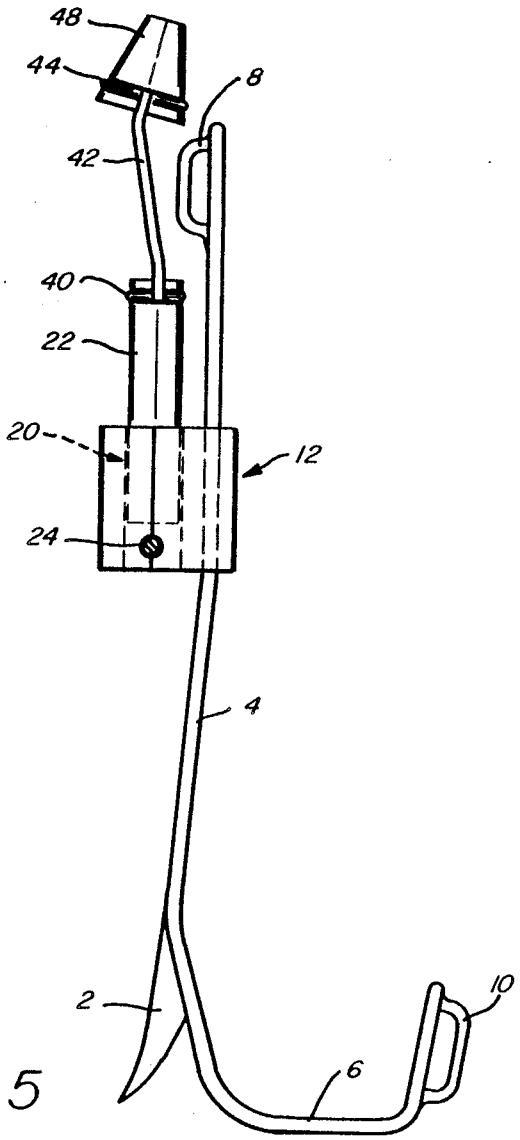
FIG. 5 is an elevation in partial cross-section showing the gaff guard at rest.

After the housing 22 is vertically above the cavity 20, the lifting force on gaff cover cup 48 is released. The force of compressed spring 32 then draws the housing 22 downwardly into cavity 20 (FIGS. 3 and 5).

It is preferred that the gaff guard G be constructed of strong, lightweight, relatively corrosion resistant materials such as aluminum or its alloys, polymer composites and the like. However, other materials may also be used.

The preferred construction of the gaff cover cup 48 for protecting the gaff 2 is a conical metal component, shaped to accommodate the barbed gaff point, coated with a polymeric composition, preferably a thermoplastic polymer. Further, the coupling assembly 12 may be fabricated from plastic composites using metallic fasteners and bolts, pins or rods. Likewise, the housing 22 may be fabricated from structural plastic composites or strong, preferably corrosion resistant, lightweight metals, and the like.

The foregoing disclosure and description of the invention are illustrative and explanatory thereof, and various changes in the size, shape and materials, as well as in the details of the illustrated construction may be made without departing from the scope and spirit of the invention as disclosed above and claimed below.

I claim:

1. A gaff guard for covering a gaff on a climbing iron, comprising:

(a) gaff cover cup means for covering the gaff;
(b) said gaff cover cup means being selectively removable from the gaff;
(c) resilient means for holding said gaff cover cup means in place on the gaff;
(d) housing means for enclosing said resilient means;
(e) clamp means for attaching to the climbing iron;
(f) said clamp means having a cavity formed therein for receiving said housing means; and
(g) pivot means for pivoting said housing means when said gaff cover cup is removed from the gaff.

2. The gaff guard of claim 1 wherein the resilient means is a spring, said spring being located between a stop means and the upper end of said housing means.

3. The gaff guard of claim 2 wherein one end of a plunger rod is attached to the stop means, the other end of said plunger rod extending vertically from the housing means.

4. The gaff guard of claim 3 wherein said clamp means comprises a connector member having a shank portion.

5. The gaff guard of claim 4 wherein said pivot means comprises a pivot ring on the other end of the plunger extending from the housing means, said pivot ring pivotally encircling the shank of said connector member.

6. The gaff guard of claim 5 wherein the clamp means comprises two segments, each of said segments defining a portion of a slot able to accommodate the shank of a climbing iron.

7. The gaff guard of claim 6 wherein the clamp means further comprises semi-circular vertical recesses in outer body portions of the clamp means, said vertical recesses forming said cavity for receiving said housing means.

8. The gaff guard of claim 7 wherein the gaff cover means is connected to said housing means by at least one cup connector rod.

9. The gaff guard of claim 8 wherein each end of said cup connector rod is supplied with an arcuate connector rings; one of said connector rings being adapted to snap into a slot around the lower end of the housing means, the other connector ring being adapted to fit into a slot around the top end of the gaff cover cup.

10. The gaff guard of claim 9 wherein the gaff cover cup comprises a supportive insert coated with a polymeric composition.

11. The gaff guard of claim 1 wherein the clamp means comprises two segments, each of said segments defining a portion of a slot able to accommodate the shank of a climbing iron.

12. The gaff guard of claim 11 wherein the clam means further comprises semi-circular vertical recesses in outer body portions of the clamp means, said vertical recesses forming said cavity for receiving said housing means.

13. The gaff guard of claim 12 wherein the gaff cover means is connected to said housing means by at least one cup connector rod.

14. The gaff guard of claim 13 wherein each end of said cup connector rod is supplied with an arcuate connector rings; one of said connector rings being adapted to snap into a slot around the lower end of the housing means, the other connector ring being adapted to fit into a slot around the top end of the gaff cover cup.

15. The gaff guard of claim 14 wherein the gaff cover cup comprises a supportive insert coated with a polymeric composition.

* * * * *